US012065889B2

(12) United States Patent
Brodie et al.

(10) Patent No.: US 12,065,889 B2
(45) Date of Patent: Aug. 20, 2024

(54) SECURING SYSTEM INTENDED TO SECURE A CABLE TO A TUBE

(71) Applicant: VALLOUREC OIL AND GAS FRANCE, Aulnoye-Aymeries (FR)

(72) Inventors: Alastair John Brodie, Meudon (FR); Maxime Vannetzel, Meudon (FR)

(73) Assignee: VALLOUREC OIL AND GAS FRANCE, Aulnoye-Aymeries (FR)

( * ) Notice: Subject to any disclaimer, the term of this patent is extended or adjusted under 35 U.S.C. 154(b) by 0 days.

(21) Appl. No.: 18/040,665

(22) PCT Filed: Jul. 28, 2021

(86) PCT No.: PCT/EP2021/071176
§ 371 (c)(1),
(2) Date: Feb. 6, 2023

(87) PCT Pub. No.: WO2022/028987
PCT Pub. Date: Feb. 10, 2022

(65) Prior Publication Data

US 2023/0304360 A1 Sep. 28, 2023

(30) Foreign Application Priority Data

Aug. 6, 2020 (EP) ..... 20189903

(51) Int. Cl.
*E21B 17/02* (2006.01)
*E21B 17/10* (2006.01)

(52) U.S. Cl.
CPC ..... *E21B 17/026* (2013.01); *E21B 17/1035* (2013.01)

(58) Field of Classification Search
CPC ..... E21B 17/026; E21B 17/1035
See application file for complete search history.

(56) References Cited

U.S. PATENT DOCUMENTS 5,598,995 A 2/1997 Meuth et al.
5,973,270 A 10/1999 Keller
(Continued)

FOREIGN PATENT DOCUMENTS

GB 2201177 A * 8/1988 ..... E21B 17/1035
GB 2 419 906 A 5/2006
(Continued)

OTHER PUBLICATIONS

U.S. Appl. No. 18/040,488, filed Feb. 3, 2023.
International Search Report Issued Oct. 6, 2021, in PCT/EP2021/071176, filed on Jul. 28, 2021, 4 pages.

*Primary Examiner* — Kristyn A Hall
(74) *Attorney, Agent, or Firm* — Oblon, McClelland, Maier & Neustadt, L.L.P.

(57) ABSTRACT

Securing system intended to secure a cable to a tube for a tubular column for oil & gas, energy, or storage applications, said securing system comprising:—a bearing surface and an outside surface, the bearing surface being turned inwardly, said bearing surface defining an inside housing for the tube, the outside surface being turned outward relative to the bearing surface,—a tube fixing mechanism having an open state and a closed state, the tube fixing mechanism being configured to fix the securing system on the tube in the closed state of the tube fixing mechanism, the tube being housed in the inside housing in said closed state of the tube fixing mechanism, said tube fixing mechanism being mobile relative to the tube in an open state of the tube fixing mechanism; said tube fixing mechanism comprises a band, the band extending along a longitudinal axis, the band extending radially, the band extending around the tube, said band forming the bearing surface,—a cable securing mechanism having an outside housing for securing the cable, said outside housing having an opening for receiving, through
(Continued)

said opening, the cable inside the outside housing, said opening of the outside housing being arranged on the outside surface.

10 Claims, 5 Drawing Sheets

(56) References Cited

U.S. PATENT DOCUMENTS

| | | | |
|---|---|---|---|
| 6,832,427 | B2 | 12/2004 | Meuth et al. |
| 7,861,982 | B1 | 1/2011 | McClure |
| 2002/0096611 | A1 | 7/2002 | Meuth et al. |
| 2003/0029979 | A1 | 2/2003 | Meuth |
| 2007/0231074 | A1 | 10/2007 | Cupolillo |
| 2011/0316274 | A1 | 12/2011 | Gronlund et al. |

FOREIGN PATENT DOCUMENTS

| | | | |
|---|---|---|---|
| WO | WO 2004/064215 | A1 | 7/2004 |
| WO | WO 2010/107322 | A1 | 9/2010 |

* cited by examiner

SECURING SYSTEM INTENDED TO SECURE A CABLE TO A TUBE

TECHNICAL FIELD

The present invention relates to securing systems for metal tubes intended for use in a tubular column for oil & gas, energy or storage application such as operating hydrocarbon wells, geothermal or carbon capture.

The present invention particularly relates to a securing system for securing at least one cable to a tube in a tubular hydrocarbon column. The present invention also relates to a metal tube equipped with such a securing system.

TECHNOLOGICAL BACKGROUND

A tubular hydrocarbon column or working string generally consists of a plurality of tubes attached together. More specifically, a tubular hydrocarbon column for hydrocarbon wells or similar wells generally comprises a tubing string and several casing strings. The tubing strings consists of a plurality of completion tubes accommodated inside the casing string. The casing string consists of a plurality of casing tubes arranged inside a drilling hole of the well. The casing tubes have a larger diameter cross-section than the diameter cross-section of the completion tubes and surround said completion tubes. In the lower part of the casing string, the casing tubes are also called liner tubes.

The casing strings are needed to maintain borehole stability, prevent contamination of water sands, and control well pressures during drilling, production, and/or workover operations.

The casing tubes and the completion tubes are made of steel and may be made, without limitation, according to API standards, for instance API standard Specification 5CT or 5CRA for standard Casing and Tubing. For example, the steel is one of grade L80, P110 or Q125 standards.

Two tubes of a string may be attached by a threaded joint or connection. Typical threaded joint for connecting a first tube to a second tube may include a male threaded portion formed on the outer peripheral surface of the first tube, also called as a pin end, and a female threaded portion formed on the inner peripheral surface of the second tube, also called as a box end. The threaded portions cooperate so as to attach the first tube to the second tube, thus forming a threaded joint.

Another type of threaded joint may include a coupling box for attaching a first tube and a second tube. Each first tube and second tube have, at both ends thereof, a male threaded portion formed on the outer peripheral surface of said tube, also called pin end. A coupling box having an inner hole provided with, at both ends thereof, a female threaded portion formed on the inner periphery of the hole is mounted on the first tube. The coupling box is generally mounted on one end of the first tube by means of the cooperation between the male threaded portion of said end of the first tube and the female threaded portion of a first end of the coupling box. By way of this arrangement, the assembly of the first tube and the coupling box has first end with a male threaded portion and a second end with a female threaded portion formed by the second end of the coupling box. The second tube may be attached to the first tube by means of one of the male threaded portions of said second tube and the female threaded portion of the second end of the coupling box.

Such threaded tubular connections are subjected to a variety of combination of stresses that may vary in intensity or change in direction, such as, for example, axial tension, axial compression, inner pressure bending force, torsional force, etc. Threaded tubular connections are thus generally designed to support those stresses, withstand rupture and provide tight sealing.

The solidity of a string of tubes thus generally relies on the absence of wear on the parts or portions forming the threaded connection or joint. It has therefore been proposed devices for protecting the threaded portions of tubes having a male threaded portion and a female threaded portion.

For operations on site, it is necessary to remove the protecting device prior to installing the tube in a well. It is preferable to remove the protecting device at the latest stages prior to installing the tube in the well. These operations are particularly time consuming and demand a particular attention from operators who also have to manage tubes. The installation process of a column is thus rendered more complicated by the use of protecting devices and weak points of a tube are not protected during installation of the column.

Furthermore, when mounting the male threaded portion of the second tube into the female threaded portion of the first tube or of the coupling box, a stabbing guide is generally used. Such stabbing guide is positioned by an operator before inserting the end of the second tube into the end of the first tube or the coupling box and then removed before screwing the second tube in the first tube or the coupling box. Such operation also increases the operation time of installation of the column.

Moreover, tubular hydrocarbon columns may be installed either onshore of offshore drilling rings, and they can be used to support electric cables to power submersible equipment, such as pumps, safety valves and other downhole equipment. Tools called clamps are generally used to accommodate such electric cables. These clamps are usually installed on tubes, particularly on coupling boxes, and need generally a plurality of operators and heavy tools for installation. Therefore, installation of such clamps on all coupling boxes of a column is time consuming on rigs, leading to costly operations.

Additionally, during the installation, it is required to obtain a good alignment of the cables from a tube to another tube. In fact, it is problematic to have cables that roll up all around the tubes when descending a column. Indeed, a tubular column can present a great length and may reach thousands of meters, thus, there is more and more weight and length of cables when they roll up on the tubes, thus providing more and more weight on the tubes For example, in a normal situation, a cable has a weight of 5 kg for 12 meters of length and tubular columns can reach 3 kms or more. Such overweight can be source of instability for the entire column and additionally an unnecessary and costly expense of resources. Another consequence is the risk of generating more cables pull out or cables tearing. Such roll up can occur because when the clamping device is installed in order to fix a cable, said cable is loose and can be pulled in the left or in the right direction beyond an acceptable tolerance of approximatively 20 degrees. Therefore, when the cable is wrongly installed, the clamping device must be uninstalled, and the operation must be entirely and correctly repeated, thus increasing significantly the global installation time of a column.

There is therefore a need to reduce the installation time of a column, also called the "critical path activity". Indeed, said critical path activity is today around 200 seconds per tube, which leads to expensive installation operations, considering the high cost for a day rental of a rig.

We know from the prior art the following documents:

U.S. Pat. No. 5,598,995 disclose a high strength clamp assembly utilizing flexible straps to securely clamp the members to one another.

WO2010/107322 disclose a riser clamp made up of several parts and designed to carry a plurality of fluid pipes in parallel with and spaced apart from a surface coated steel riser, which riser is designed to be deployed into the sea for communication between a well head at the seabed and a surface vessel, said riser clamp being designed for frictional, non-rotatable fixation to the surface coated riser and is further provided with a plurality of pipe saddles carrying the respective fluid pipes.

WO2004/064215 disclose a cable clamp device for use in a well bore to secure cables to pipes and the like, that includes a relatively flexible fastening member, and a retaining means that accepts and retains the fastening member. The cable clamp device including a cable restraining means capable of accepting and constraining at least one cable as the cable clamp device is attached to a pipe.

U.S. Pat. No. 6,832,427 disclose clamp assemblies for connecting one member to a support member, and more particularly to a high strength buoyant clamp assembly to attach a pipe or line, such as an umbilical line, to another pipe, and shields the pipe and line from contact with each other and surrounding media.

U.S. Pat. No. 5,973,270) disclose a cable protector for use within a wellbore has at least one housing member adapted to be placed against a wellbore device, such as an electric submergible pumping system.

GB2419906 disclose a combined centralizer and a clamp to anchor cable and hose to a production tube for downhole use. The clamp includes a metallic belt for the production tube, with integrated rigid curved projections for anchoring the cable and hose. It also has a securing portion including complimentary flanges with slots for accepting screws.

U.S. Pat. No. 5,598,995 disclose A clamp assembly and method for clamping an elongate member to a support member. The clamp assembly comprises a receptacle adapted to at least partially receive the elongate member, a pair of flexible support straps connected to the receptacle, and a pair of flexible clamping straps. The pair of flexible support straps are capable of matingly engaging one another around the support member and the pair of flexible clamping straps are capable of matingly engaging one another around the elongate member and the support member.

The aim of the present invention is to overcome the aforementioned drawbacks.

It is a particular object of the present invention to improve the operations on site, particularly the easiness and speed of operations in view of reducing time needed for the installation process of the tubes of a column on rigs.

According to an aspect of the invention, it is also an object of the invention to provide an easy and fast alignment of the ends of the tubes. An idea of the invention is also to improve the protection of the coupling box portion of a tube intended to form a threaded joint during the installation process of the tube.

The invention provides a securing system intended to secure a cable to a tube for a tubular column for oil & gas, energy, or storage applications, said securing system comprising:

a bearing surface and an outside surface, the bearing surface being turned inwardly, said bearing surface defining an inside housing for the tube, the outside surface being turned outward relative to the bearing surface, a tube fixing mechanism having an open state and a closed state, the tube fixing mechanism being configured to fix the securing system on the tube in the closed state of the fixing mechanism, the tube being housed in the inside housing in said closed state of the tube fixing mechanism, said fixing mechanism being mobile relative to the tube in the open state of the fixing mechanism;

a cable securing mechanism having an outside housing for securing the cable, said outside housing having an opening for receiving through said opening the cable in the outside housing, said opening of the outside housing being arranged on the outside surface.

Thanks to these features, it is possible to secure a cable to a tube easily and quickly on site. Indeed, as the opening of the outside housing is arranged on an outer surface of the securing system, it is possible to house a cable in the outside housing of the cable securing mechanism even if a tube is housed in the inside housing and without removing the securing system of the tube. Therefore, the securing system can be pre-installed on the tube, for instance in the tube manufacture or during any step between the tube manufacturing and the installation of the tube in the well, and the cable can be secured on site without removing the securing system from the tube. As the securing system can be pre-installed on the tube before the installation of the tube in the well and the cable can be secured to the pipe without removing the securing system of the tube, there is no need to remove and/or house the tube in the inside housing of the securing system on site and the time required to secure the cable to the tube on site is very low.

Such a securing system may comprise one or more of the hereafter features.

According to an embodiment, the outside housing is a groove. According to an embodiment, the outside housing extends parallel to a longitudinal axis. According to an embodiment, the outside housing has a "U" shape cross section in a plane perpendicular to the longitudinal axis.

According to an embodiment, the opening comprises a first side portion, a central portion and a second side portion. According to an embodiment, the central portion extends parallel to the longitudinal axis. According to an embodiment, the central portion is turned facing away relative to the longitudinal axis. According to an embodiment, the first side portion and/or the second side portion extends radially. In other words, in the case of an outside housing formed by a groove, such a groove extends parallel to the longitudinal axis with an open side facing away relative to the longitudinal axis and its two opposite end along the longitudinal axis are opened and form the first and second open sides of the opening.

According to an embodiment, the bearing surface is switchable between an opened position and a closed position, said tube fixing mechanism being configured to switch the bearing surface between the opened position and the closed position, the bearing surface being configured to bear against the tube so as to fix the securing system on the tube in the closed position.

According to an embodiment, the bearing surface is configured to be in the opened position in the open state of the tube fixing mechanism and in the closed position in the closed state of the tube fixing mechanism.

According to an embodiment, the bearing surface comprises a first portion and a second portion, the distance between the first portion and the second portion being shortest in the closed position than said distance in the opened position. These portions of the bearing surface can therefore clamp the tube in order to fix the securing system on the tube.

According to an embodiment, the bearing surface is, at least partially, deformable. In an embodiment, the first portion of the bearing surface and/or the second portion of the bearing surface has a different shape in the closed position and in the opened position. According to an embodiment, the first portion of the bearing surface and/or the second portion of the bearing surface has a larger curvature radius in the opened position than in the closed position.

According to an embodiment, the tube fixing mechanism comprises a cam mechanism; said cam mechanism comprising a first cam surface and a second cam surface, the cam mechanism being configured to modify the distance between the first portion of the bearing surface and the second portion bearing surface. Thanks to this cam mechanism, it is possible to switch the bearing surface between the closed position and the opened position easily.

According to an embodiment, the tube fixing mechanism comprises a band, said band defining an open ring having a first terminal end and a second terminal end, the distance between said first terminal end and the second terminal end being distinct in the closed position of the bearing surface and the opened position of the bearing surface. Such a band is easy to manufacture and can be easily deformed so as to clamp the tube. Such a deformable band can be made in a single piece or a plurality of pieces joined together, for instance a plurality of portions circumferentially joined together by spacers, for instance tie rods, hinges or metal ring like a chain ring.

The band is configured such that a modification of the distance between the first terminal end and the second terminal end of the band modify the distance between the first portion of the bearing surface and the second portion of the bearing surface. Such a modification of the distance between the first terminal end and the second terminal end of the band can be measured circumferentially, in straight, said distance increasing or decreasing for switching the bearing surface from the opened position to the closed position. For instance, reducing the circumferential distance between the first terminal end and the second terminal end of the band can tighten the band around the tube and bringing the first portion of the bearing surface and the second portion of the bearing surface to bear against the tube.

According to an embodiment, the band is made of a metallic material, for example stainless metal, for instance in the form of a sheet metal.

According to an embodiment, an inner side of the band comprises the first portion and the second portion of the bearing surface. However, a bearing surface having a first and a second portion can be manufactured in a different way. For instance, the tube fixing mechanism may comprise two legs mounted in rotation one to each other, each leg having a respective portion of the bearing surface, the tube fixing mechanism being configured to block in rotation the position of the legs in the closed or the open state.

According to an embodiment, the securing system comprises a central body, said central body comprising a locking lever, the first terminal end of the band being anchored to the central body, the second terminal end of the band being linked to the locking lever, the locking lever being mounted mobile in rotation on the central body, the first cam surface being arranged on the central body, the second cam surface being arranged on the locking lever. According to an embodiment, the cam mechanism is configured so that a rotation of the locking lever relative to central body modify the distance between the first terminal end of the band and the second terminal end of the band.

Thanks to these features, the distance between the first terminal end and the second terminal end can be amended easily and quickly. Indeed, this distance can be amended, and therefore the securing system fixed to the tube, due to a simple rotation of the locking lever by the way of the came mechanism.

According to an embodiment, in the open state of the tube fixing mechanism with the tube housed in the inside housing, the securing system is mobile in rotation around the tube and limited in radial displacement relative to a longitudinal axis of the tube by an abutment of the bearing surface on the tube.

Thanks to these features, it is possible to turn the securing system around the tube without removing the tube from the inside housing. Thus, the circumferential orientation of the opening of the outside housing can be amended without removing the tube from the inside housing. By amending the circumferential orientation of the opening of the outside housing, it is possible to arrange the position of said opening according to the position of the cable relative to the tube, thus no matters where the cable is around the tube when the tube is inserted in the well, the securing system can be circumferentially oriented to receive the cable within the angular tolerance of orientation for the cable on the tube.

However, the circumferential orientation of the opening of the outside housing can be amended thanks to other embodiments of the securing system. For instance, according to an embodiment, the cable securing mechanism could be mobile around the inside housing relative to the bearing surface. Thus, the tube could be fixed by the tube fixing mechanism and remaining in the inside housing while the securing mechanism is turned relative to the tube and the bearing surface for circumferentially arrange the opening in the requested orientation. Thus, even if the securing system in pre-installed on the tube, the orientation of the cable securing mechanism on such a pre-installed securing system doesn't matter, the securing system can secure the cable on the tube within the requested angular orientations tolerances of the cable by changing the orientation of the cable securing mechanism.

The cable securing mechanism can secure the cable in the outside housing according to different embodiments. For instance, according to an embodiment, the cable securing mechanism comprises a lid, said lid being mobile relative to the outside housing between a locked position and an unlocked position, the opening of the outside housing being free in the unlocked position of the lid so as to allow the cable to be inserted in the outside housing through said opening, the lid closing the outside housing in the locked position so that the cable is secured to the securing system when said cable is housed in the outside housing and the lid is in the locked position.

Thanks to such a lid, the cable can be housed in the outside housing in the unlocked position of the lid and can be secured in the outside housing by moving the lid from the unlocked position to the locked position of the lid.

According to an embodiment, the lid in the locked position close the outside housing by partially covering the opening, for instance by covering the central portion of the opening and keeping the first side portion and the second side portion of the opening free. Such a partial closing of the opening allows housing a long cable in the outside housing, said long cable being secured in the outside housing by the lid closing the central portion and crossing the outside housing through the two side portions of the opening.

According to an embodiment, the outside housing comprises at least one clamp for securing the cable. According to an embodiment, the lid and the outside housing are configured to radially clamp the cable in the outside housing, for instance by squeezing said cable between the lid and a bottom of the outside housing. According to an embodiment, said clamp comprise a lever or a clip circumferentially squeezing the cable. According to an embodiment, the lid is a thin piece of metal that covers the cable for radially holding the cable in the outside housing, for instance a thin piece of metal having a radial thickness from 0.5 to 5 mm.

According to an embodiment, the locking lever forms the lid. Thanks to this feature, a simple rotation of the locking lever relative to central body can both fix the securing system on the tube and, in the same rotation movement, closing the outside housing for securing the cable. Moreover, such a locking lever can both close the outside housing and fix the securing without tools, just by a manual rotation of said locking lever.

According to an embodiment, the cable securing mechanism has a plurality of outside housing, each outside housing being configured to secure the cable, said outside housings having an opening for receiving through said opening the cable in the outside housing, said opening of the outside housings being arranged on the outside surface. Thanks to such a plurality of outside housing, the securing system can secure the cable on the tube within the requested angular orientations tolerances of the cable without or with a limited amendment of the orientation of the cable securing mechanism.

According to an embodiment, the openings of the outside housings are circumferentially distributed on the outside surface.

According to an aspect of the invention, the invention provides a securing system intended to secure a cable to a tube for a tubular column for oil & gas, energy, or storage applications, said securing system comprising:

- a bearing surface and an outside surface, the bearing surface being turned inwardly, said bearing surface defining an inside housing for the tube, the outside surface being turned outward relative to the bearing surface,
- a tube fixing mechanism having an open state and a closed state, the tube fixing mechanism being configured to fix the securing system on the tube in the closed state of the tube fixing mechanism, the tube being housed in the inside housing in said closed state of the tube fixing mechanism, said tube fixing mechanism being mobile relative to the tube in an open state of the tube fixing mechanism; said tube fixing mechanism comprises a band, the band extending along a longitudinal axis, the band extending radially, the band extending around the tube, said band forming the bearing surface.
- a cable securing mechanism having an outside housing for securing the cable, said outside housing having an opening for receiving, through said opening, the cable inside the outside housing, said opening of the outside housing being arranged on the outside surface.

Such a band can be easily deformable around the tube. Thus, thanks to the band forming the bearing surface, said bearing surface can be deformable and thus allowing an overextension of said bearing surface around a tube. Thanks to the overextension, the band can house different sizes of tubes, thus the securing mechanism can be used and reused on different sized tube if needed.

Moreover, such a deformable band can be easily tightened around the tube in order to bear the bearing surface against the tube. Thus, the fixing mechanism can fix the securing system on the tube easily and quickly just by tightening the band around the tube.

Such a securing system may comprise one or more of the above cited or following features.

According to an embodiment of the securing system, the tube fixing mechanism is mobile relative to the tube when said tube is housed in the inside housing in an open state of the tube fixing mechanism.

Thanks to these features, the tube fixing mechanism in the open state can be turned around the tube without removing the tube from the inside housing. Thus, the orientation of the securing system relative to the tube can be amended without removing the securing system from the tube. It is therefore possible to pre-install the securing mechanism on the tube and, when the tube is installed in the well, change the orientation around the tube of the securing system in order to arrange the cable in front of the opening without removing the securing system from the tube. The orientation of the securing system, and especially the opening of the securing mechanism, can thus be amended on site quickly and easily.

According to an embodiment of the securing system, the band of the tube fixing mechanism is extending around circumferentially, i.e. orthoradially, around the tube which has a circular cross-section, said band forming the bearing surface.

According to an embodiment, the band can extend around the tube when said band is pulled against the tube.

According to an embodiment of the securing system, the tube fixing mechanism comprises a central body. According to an embodiment, the band has a first terminal end and a second terminal end, the first terminal end being fixed to the central body, the second terminal end being mounted on the central body mobile relative to the central body between a closed position and a remote position.

Thanks to this configuration between the band and the central body which are fixed together only by one side for each of them, the second side of the band being mobile relative to the central body, the securing system can be loaded or removed axially on the tube easily, the securing system surrounding said tube such as an open belt.

Thanks to the tube fixing mechanism, it is conceivable to preinstall the securing mechanism before all rig's operations, therefore transporting tubes already loaded with the securing mechanism and saving significantly the amount of time needed to process things during said rig's operations.

The term fix defines the link between to two items or features restraining or preventing the movement according to certain directions. For example, an object can be mounted in rotation on another object and turn around its axis of rotation, but its relative position along other axis remains the same.

According to an embodiment of the securing system, the band has a first terminal end and a second terminal end, the first terminal end being fixed to the central body, said first terminal end and second terminal end facing opposed directions.

According to an embodiment of the securing system, the second terminal end is mounted, directly or indirectly, on the central body mobile relative to the central body between a closed position and a remote position.

According to an embodiment of the securing system, the first terminal end of said band comprises a first terminal sleeve, the first terminal sleeve housing a first shaft, said first shaft fix the central body to the band.

Thanks to these features, the band is bonded to the central body. Thanks to the terminal ends, the band can house attachment or connection elements, such as the first terminal sleeve, which can bond with other elements such as the central body. The central body remains mobile relative to the band thanks to the first shaft which is pivotable when housed inside the sleeves of the band and the central body.

According to an embodiment of the securing system, the second terminal end of said band comprises a second terminal sleeve housing a second shaft.

According to an embodiment of the securing system, said second shaft is linked to the central body.

According to an embodiment of the securing system, the central body comprises a locking mechanism configured to bring the second terminal end of said band and the central body closer to each other in a closed state.

According to an embodiment of the securing system, the locking mechanism comprises a locking lever pivotably mounted on the central body and configured to rotate between an open state and a closed state.

According to an embodiment of the securing system, the locking mechanism comprises a locking lever pivotably mounted on the central body and configured to rotate between an open state in which said locking lever is radially away from the central body and a closed state.

According to an embodiment of the securing system, the locking lever is pivotably mounted on a rotational shaft parallel to the longitudinal axis of the tube fixing mechanism.

According to an embodiment of the securing system, the locking mechanism comprises a pretention screw which locks the rotational shaft and the shaft together in a closed state.

Thanks to the locking mechanism, the securing mechanism can be easily removed if necessary, by opening the locking lever, for instance manually or remotely using a mechanical device.

Thanks to the locking mechanism, the securing system can be closed in order to prevent any longitudinal or rotational movement of said securing system toward the tube.

Thanks to the locking lever, the second terminal end of the band which is a free end can be brought closer to the other free end of the central body thanks to a cam mechanism. In a closing operation, the cam mechanism provided by the locking lever will increase the tension on the band by pulling said band against the tube through the contact of the bearing surface, thus enabling that the whole securing system is solidly fixed to the tube and preventing all rotational movement of said securing system. According to an embodiment, the cam mechanism is replaced by a crank mechanism which increases the tension on the band by pulling said band against the tube through the rotation of the crank.

In an opening operation, the cam mechanism provided by the locking lever will release said tension of the band, thus enabling to create a gap, said gap allowing the manual rotation of the securing system around the tube, for example to adjust it in a desired position.

Thanks to the pretention screw, the second terminal end of the band is locked to the remaining free end of the central body. Said pretention screw enables the band to be pulled toward the central body thanks to the cam mechanism in a closing operation.

According to an embodiment of the securing system, the central body comprises at least a first terminal sleeve configured to house the shaft.

According to an embodiment of the securing system, the outside housing of the cable securing mechanism comprises at least one longitudinal groove parallel to the longitudinal axis, said longitudinal groove being able to house at least one cable.

Thanks to a cable securing mechanism according to the invention, it is now conceivable to preinstall the whole device on a tube before arriving to the rig field of operation. Indeed, the invention get rid of all the difficulties of predicting where the clamping device will be facing the area of the cable will end as it only requires to untighten the securing mechanism, to adjust it in the right direction toward the cable and close it easily. Such preinstallation saves a significant amount of time thus reducing drastically the critical path activity.

According to an embodiment of the securing system, the locking lever comprises an inner surface facing the central body and the outside surface of the tube in a closed state, said inner surface comprising a plurality of tooth designed to clamp the cable.

Thanks to the plurality of tooth, it is easier to clamp the cable in a closing operation of the locking lever, preventing said cable to slip away and enables to accompany the cable directly inside longitudinal groove.

According to an embodiment of the securing system, the cable securing mechanism comprises a holding mechanism configured to maintain the locking lever in a closed state.

According to an embodiment of the securing system, the holding mechanism comprises a holding lever pivotably mounted on the central body and rotates longitudinally between a closed state and an open state.

Thanks to the holding lever, the locking lever is totally blocked, thus providing additional security by preventing that the locking lever unlocks itself during utilization inside the column. The holding lever can also provide additional strength to complete the closing of the locking lever in a closing operation.

According to an embodiment, the invention also provides a securing system intended to secure a cable to a tube for a tubular column for oil & gas, energy, or storage applications, said securing system comprising:

- a first ring,
- a second ring,
- a central body arranged between the first ring and the second ring along a longitudinal axis, wherein:

- the first ring has a lifting surface turned toward the second ring, the lifting surface extending radially, said lifting surface being configured to bear against the tube so as to lift the tube and block the displacement of the first ring along a longitudinal axis toward the second ring,
- the second ring has an abutment surface turned toward the first ring, the abutment surface extending radially, said abutment surface being configured to bear against the tube so as to block the displacement of the second ring along the longitudinal axis toward the first ring,
- the central body has a first longitudinal end and a second longitudinal end, the first longitudinal end of the central body having a first blocking mechanism configured to link said first end to the first ring so as to block the displacement of said first ring relative to the central body along the longitudinal axis away from the second ring, the second longitudinal end of the central body having a second blocking mechanism configured to link said second end to the second ring so as to block the displacement of said second ring relative to the central body along the longitudinal axis away from the first ring, the securing system further comprising a cable securing mechanism having an outside housing for securing the cable, said outside housing having an opening for receiving through said opening the cable in the outside housing, said opening of the outside housing being arranged on an outside surface of the securing system, said outside surface being turned outward relative to an inside housing of the securing system, said inside housing being configured to house the tube.

Thanks to these features, the securing system can be used to lift a tube or even the string for the installation of the tube or the string in the well. More particularly, the lifting surface of the securing system can cooperate with a corresponding surface of the tube, for instance a shoulder surface formed by a coupling box of the tube.

Moreover, thanks to the second ring, the securing system can be used as a protector for the thread portion of the tube if said securing system is pre-installed on the tube before its installation in the well.

Thus, such a securing system can provide the above mentioned advantages, regarding for instance the easy and quick use on the rig to secure a cable to a tube, and can further be used to lift said tube for its installation in the well and protect the tube during its transportation and displacement on the rig. Moreover, thanks to the structure of the securing system, i.e. two separates rings and a central body, each portion of the securing system can be manufactured using materials dedicated to its main function. For instance, the first ring can be manufactured using a material having resistance and mechanical strength properties allowing to lift the whole string in the well while the central body and the second ring can be manufactured in lighter materials.

Such a securing system may comprise one or more of the above-mentioned features and/or one or more of the following features.

According to an embodiment, the second ring comprises a guiding surface, said guiding surface being turned opposed to the first ring, said guiding surface being tapered relative to the longitudinal axis so as to have a first longitudinal end of said guiding surface having a large diameter and a second longitudinal end of said guiding surface having a small diameter, the second longitudinal end of the guiding surface being arranged between the first end of the guiding surface and the first ring along the longitudinal axis.

According to an embodiment, the small diameter is configured to be radially outwardly offset relative to an inner diameter of the tube, for instance radially outwardly offset relative to an inner thread of the tube.

Thanks to these features, the second ring can be used as a guiding ring for guiding the insertion of another tube in the tube on which is mounted the securing system. In other words, the securing system provides the functions to clamp a cable on a tube, as explained above, but also to lift the tube or the string and further to guide the insertion of another tube in the tube on which the securing system is mounted. The material used for manufacturing such a second ring can therefore be selected according to the function of guiding the insertion of a second tube in the tube on which is mounted the securing system.

According to an embodiment, the first ring has a first inner surface, said first inner surface being intended to surround a first portion of the tube, the second ring has a second inner surface, said second inner surface being intended to surround a second portion of the tube, the central body has a third inner surface, said third inner surface being intended to be turned toward a third portion of the tube, the third portion of the tube being arranged between the first portion of the tube and the second portion of the tube along a longitudinal axis of the tube, said first inner surface, second inner surface and third inner surface forming the inside housing for the tube. According to an embodiment, the first inner surface and/or the second inner surface and/or the third inner surface comprises grabbing reliefs, for instance teeth or rid. Such grabbing reliefs bears against the, respectively the first portion of the tube, the second portion of the tube or the third portion of the tube in order to block or limit the rotation of said inner surfaces relative to the tube.

According to an embodiment, the second ring comprises an inner shoulder, said shoulder forming the abutment surface, said inner shoulder extending radially inwardly from the second inner surface. Thus, the second inner surface allows a good insertion of the second ring on the end of the tube while such an inner shoulder blocks the displacement of the second ring toward the first ring by abutment on the end of the tube of said inner shoulder.

According to an embodiment, the second ring comprises a central inner surface arranged between the second inner surface and the guiding surface along the longitudinal axis, said central inner surface being parallel to the longitudinal axis and joining the inner shoulder and the guiding surface. Thanks to these features, the second ring has a longitudinal thickness providing a good mechanical resistance, especially regarding both the inner shoulder and the guiding surface.

According to an embodiment, the third inner surface is radially offset outwardly relative to an inner diameter of the lifting surface. Such a third inner surface is for instance intended to surround a third portion of tube formed by the coupling box, and therefore having a larger outside diameter than the main tube outside diameter.

According to an embodiment, the outside surface is arranged on the central body. As for the first ring and the second ring, the material used for manufacturing the central body can be selected according to the associated function of securing the cable on the tube, thus having a mechanical resistance strong enough to support the cable weight or a rigidity, dimensions and elasticity allowing deformation of the outside housing for receiving the cable in the outside housing but elasticity properties and dimensions of said outside housing allowing to clamp said cable when housed in the outside housing.

According to an embodiment, the securing system further comprises a tube fixing mechanism having an open state and a closed state, the tube fixing mechanism being configured to fix the securing system on the tube in the closed state of the fixing mechanism, the tube being housed in the inside housing of the securing system in said closed state of the tube fixing mechanism, said fixing mechanism being mobile relative to the tube in the open state of the fixing mechanism.

According to an embodiment, the tube fixing mechanism comprises a band, said band extending circumferentially around the longitudinal axis, said band having an inner surface forming a bearing surface intended bear against the tube, the band having a first terminal end and a second terminal end mobile relative one to each other so as to modify the inside diameter of said band.

According to an embodiment, the central body is mobile in rotation around the longitudinal axis relative to the first ring and/or the second ring. According to an embodiment, the first ring comprise a first outside groove extending circumferentially, the second ring comprises a second outside groove extending circumferentially, the first blocking mechanism comprising a first hook housed in the first outside groove, the second blocking mechanism comprising a second hook housed in the second outside groove. Thanks to these features, the blocking mechanism block the displacement along the longitudinal axis of the central body relative to the rings.

According to an embodiment, the first outside groove comprises a first primary abutment surface and a second primary abutment surface, the first primary abutment surface circumferentially facing the second primary abutment surface, the first hook being circumferentially arranged between the first primary abutment surface and the second primary abutment surface.

According to an embodiment, the second outside groove comprises a first secondary abutment surface and a second secondary abutment surface, the first secondary abutment surface circumferentially facing the second secondary abutment surface, the second hook being circumferentially arranged between the first secondary abutment surface and the second secondary abutment surface.

The invention further provides a column portion set comprising a pipe and a securing system as recited above, in which the tube is housed in the inside housing of the securing system, the tube fixing mechanism being in a closed state and the cable securing mechanism being fixed to the tube.

Thanks to the tube fixing mechanism and the cable securing mechanism, the critical path activity or installation time of a tube is significantly reduced, for example around 3 seconds to 5 seconds, which leads to a considerable cost reduction of the installation operations.

Thanks to the above mentioned features, the invention enables to assemble different functions in the same system, with a tube fixing mechanism being able to fix a securing system to a tube and a cable securing mechanism being able to clamp a cable to be secured to the tube, wherein both functions can be used alone or in combination.

Thanks to these features, the invention also provides a protection to the tube when installed on said tube. Indeed, such securing system provides a function of isolating, for example, a male or female end threaded tubular element from the external environment and to protect the tubes in order to prevent impact damages if they fall down.

BRIEF FIGURES DESCRIPTION

The invention will be better understood, and other objects, details, features and advantages thereof will become more clearly apparent during the course of the following description of a number of particular modes of embodiment of the invention which are given solely by way of nonlimiting illustration with reference to the appended drawings.

DETAILED DESCRIPTION

In the following description, the terms "longitudinal, "transversal", "vertical", "front", "rear", "left" and "right" are defined according to a usual orthogonal benchmark as shown on the drawings, which includes:

- a longitudinal axis X, horizontal and left to the right of front views;
- a transversal axis Y, perpendicular to the longitudinal axis X and extending from the rear to the front of front views; and
- a vertical axis Z, orthogonal to the longitudinal and transversal axis X and Y.

Moreover, in the description and claims, the terms "outside" or and "inside" and the orientations "axial" and "radial" shall be used to designate, according to the definitions given in the description, elements of the securing system or the tube. The longitudinal axis X determines the "axial" orientation. The "radial" orientation is directed orthogonally to the longitudinal axis X. The "circumferential" orientation is directed orthogonal to the axis X of rotation and orthogonal to the radial direction, i.e. orthoradially. The terms "outside" or "inside" are used to define the orientation or the relative position of one component with respect to another, with reference to the longitudinal axis X. A component close or facing said axis is referred to as inside or inner as opposed to an outside or outer component located radially at the periphery or facing away the longitudinal axis X.

Figure 1:
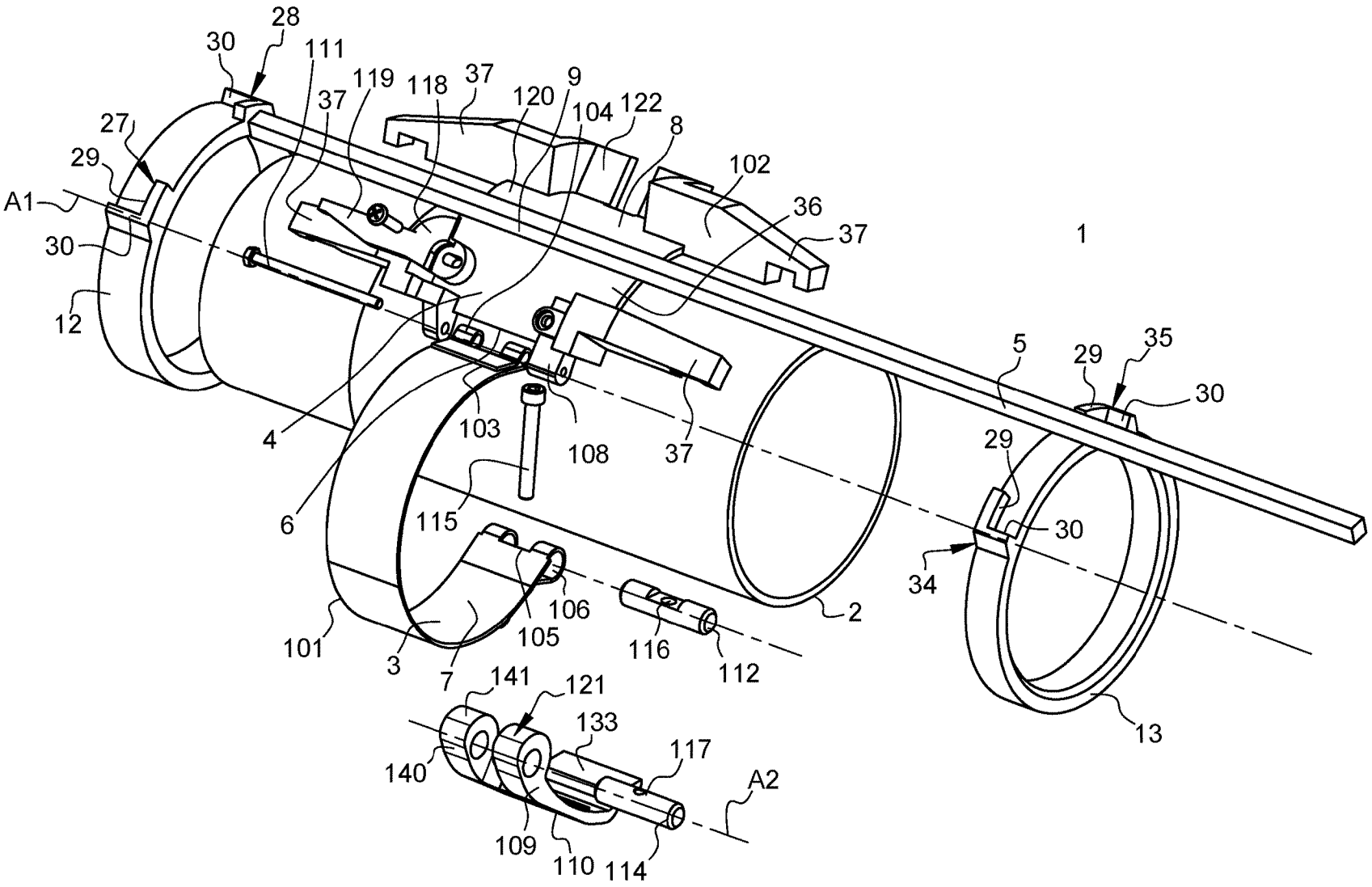
FIG. 1 is a schematic exploded view of a securing system intended to be mounted on a tube.

FIG. 1 shows a securing system 1 intended to secure a cable 5 to a tube 2. The tube 2 has a longitudinal axis A1 parallel to the longitudinal axis X as previously defined and as shown in FIG. 1.

The securing system 1 comprises a tube fixing mechanism 6, a bearing surface 3, a cable securing mechanism 9, a first 12 ring and a second 13 ring (detailed furtherly in the description).

The tube fixing mechanism 6 comprises a band 101 extending orthoradially so as to surround, partially on the shown embodiment, the tube 2. This band 101 also extends radially around the tube 2, defining the thickness of the band 101. The band 101 also extends longitudinally parallel to axis A1 thus defining the width of the band 101. This band 101 partially forms the bearing surface 3 of the securing system 1.

Said band 101 can be deformable and allows an overextension of said band 101, and consequently of the bearing surface 3, around a tube 2. Thanks to the overextension, the band 101 can house different sizes of tubes 2, thus the securing system 1 can be used and reused on different sized tubes 2 if needed.

The band 101 further comprises a first terminal end 103 and a second terminal end 105, which are facing an opposed direction as the band 101 surround circumferentially the tube 2. These terminal ends 103 and 105 comprise respectively a first terminal sleeve 104 and a second terminal sleeve 106. Each sleeve 104 and 106 can be either continuous, which means the sleeve doesn't comprise any kind of interruption, or discontinuous, which means the sleeve can admit an interruption such as a hole between two terminal extremities of a same sleeve. In the case of the embodiment as shown in FIG. 1, the first terminal sleeve 104 and the second terminal sleeve 106 are discontinuous. A sleeve can be made by many embodiments, for example in FIG. 1 the sleeve 104 and 106 consist on loops.

The securing system 1 comprises a central body 102 which completes the surrounding of the tube 2 such as an open belt. The central body 102 comprises a first terminal sleeve 108 parallel to the longitudinal axis A1.

The first terminal sleeve 104 of the band 101 and the first terminal sleeve 108 of the central body 102 both house a first shaft 111. This configuration enables the band 101 and the central body 102 to be bonded one to each other while still admitting a certain level of mobility. Indeed, the central body 102 remains mobile relatively to the band 101 thanks to the first shaft 111 which is pivotable when housed inside the sleeves 104 and 108 of the band 101 and the central body 102.

A second shaft 112 parallel to the longitudinal axis A1 is housed in the second terminal sleeve 106 of the second terminal end 105 of the band 101. The second shaft 112 comprises a through hole 116.

The tube fixing mechanism 6 comprises a locking mechanism 110 that is configured to bring the second terminal end 105 of said band 101 and the central body 102 closer to each other in a closed state of the locking mechanism 110.

The locking mechanism 110 comprise a locking lever 109 such as in FIG. 1. The locking lever 109 is pivotably mounted on the central body 102 and configured to rotate between an open state in which said locking lever 109 is radially away from the central body and a closed state. More specifically, the locking lever 109 is pivotably mounted on a rotational shaft 114 which comprise a hollowed cavity 117. Both the locking lever 109 and the rotational shaft 114 are housed on the central body 102. Such a hollowed cavity can be for instance a through bore, as shown on figures, or a blind slot.

The rotational shaft 114 present its own rotational axis A2 which is parallel to the longitudinal axis A1. The rotation shaft is mounted mobile in translation relative to the central body, as explained below.

The locking mechanism 110 comprises a pretention screw 115 which can get across the through hole 116 of the second shaft 112 and the hollowed cavity 117 of the rotational shaft 114, thus locking the rotational shaft 114 and the second shaft 112 together in a closed state.

The locking lever 109 has a curved portion 141, hereafter described, which is an off-centred portion compared to the rotational axis A2, such that when rotating the locking lever 109 around the longitudinal rotational axis A2 of the rotational shaft 114, the rotational shaft 114 is moved relative to the central body 102. The pretension screw 115, which is connected to said shafts 112 and 114 as it is slid in the corresponding hollowed cavity 117 and through hole 116, thereby bringing the second terminal end of the band towards the second free end (T2) of the central body 102. This is also explained in the FIGS. 7 and 8 hereafter.

Thanks to the locking mechanism 110, the securing system 1 can be easily removed if necessary, by opening the locking lever 109 manually or remotely.

Thanks to the locking mechanism 110, the securing system 1 can be closed in order to prevent any longitudinal or rotational movement of said securing system 1 relative to the tube.

Thanks to the locking lever 109, the second terminal end 105 of the band 101 which is a free end can be brought closer to the other free end of the central body thanks to a cam mechanism as described below.

In a closing operation, the cam mechanism provided by the locking lever 109 will increase the tension on the band 101 by pulling said band 101 against the tube 2 through the contact of the bearing surface 3, thus enabling that the whole securing system 1 is solidly fixed to the tube 2 and preventing all rotational movement of said securing system In an opening operation, the cam mechanism provided by the locking lever 109 will release said tension of the band 101, thus enabling to create a gap, said gap allowing the manual rotation of the securing system 1 around the tube 2, for example to adjust it in a desired position.

Thanks to the pretention screw 115, the second terminal end 105 of the band 101 is locked to the central body 102. Said pretention screw 115 enables the band 101 to be pulled toward the central body 102 thanks to the cam mechanism in a closing operation.

The cable securing mechanism 9 comprises an outside housing 8 which comprises at least one longitudinal groove 120 parallel to the longitudinal axis A1, said longitudinal groove 120 being able to house at least one cable 5.

Thanks to a cable securing mechanism 9 according to the invention, it is now conceivable to preinstall the whole securing system 1 on a tube 2 before arriving to the rig field of operation. Indeed, the invention get rid of all the difficulties of predicting where the cable securing mechanism will be facing the area of the cable will end as it only requires to untighten the tube fixing mechanism 6, to adjust it in the right direction toward the cable 5 and close it easily. Such preinstallation saves a significant amount of time thus reducing drastically the critical path activity.

The locking lever 109 comprises an inner surface 133 facing the central body 102 and the outside surface of the tube 2 in a closed state, said inner surface 133 comprising a grabbing surface 134 designed to clamp the cable 5.

Thanks to grabbing surface 134, it is easier to clamp the cable 5 in a closing operation of the locking lever 109, preventing said cable 5 to slip away and enables to accompany the cable 5 directly inside longitudinal groove. For example, a grabbing surface 134 can be a plurality of tooth.

Thanks to the tube fixing mechanism 6 and the cable securing mechanism 9, no tool is needed to fix said securing system 1 on the tube 1, and no tool is needed to clamp the cable 5, such that the critical path activity or installation time of a tube 2 is significantly reduced, for example around 3 seconds to 5 seconds, which leads to a considerable cost reduction of the installation operations.

Thanks to these features, the invention enables to assemble different functions in the same securing system 1, with a tube fixing mechanism 6 being able to fix the securing system on the tube 2 and a cable securing mechanism 9 being able to clamp the cable 5, wherein both functions can be used alone or in combination.

Thanks to these features, the invention also provides a protection to the tube 2 when installed on said tube 2. Indeed, such securing system 1 provides a function of isolating, for example, a male or female end threaded tubular element from the external environment and to protect the tube 2 in order to prevent impact damages if they fall down.

Figure 2:
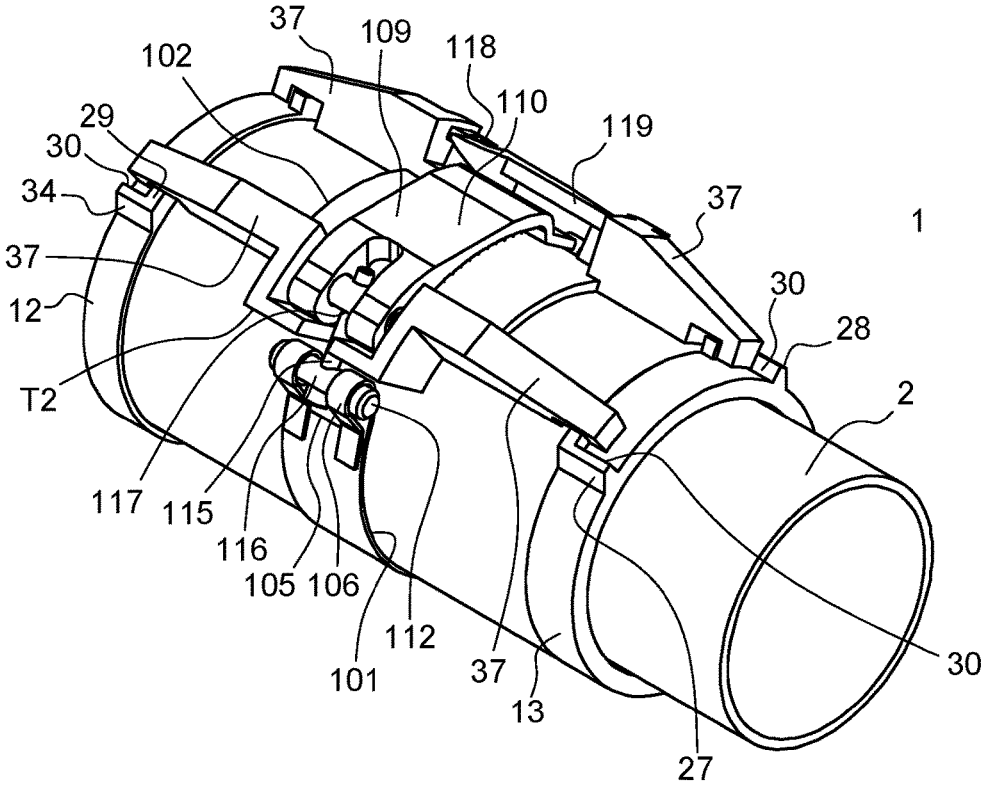
FIG. 2 is a schematic view of the securing system of FIG. 1 mounted on the tube in a closed state of a fixing mechanism of the securing system.

FIG. 2 shows the securing system 1 of FIG. 1 in an assembled view and in a closed stated. In this chosen angle of view, is illustrated the layout between the second terminal end 105 of the band 101 and the second free end (T2) of the central body 102 which are fixed together thanks to the pretention screw 115. The pretention screw 115 locks the second terminal sleeve 106 through the though hole 116 and the rotational shaft 114 though the hollowed cavity 117 together. Thus, the second terminal sleeve 106 and the rotational shaft 114 are fixed remotely together as there is no direct contact between them.

Figure 3:
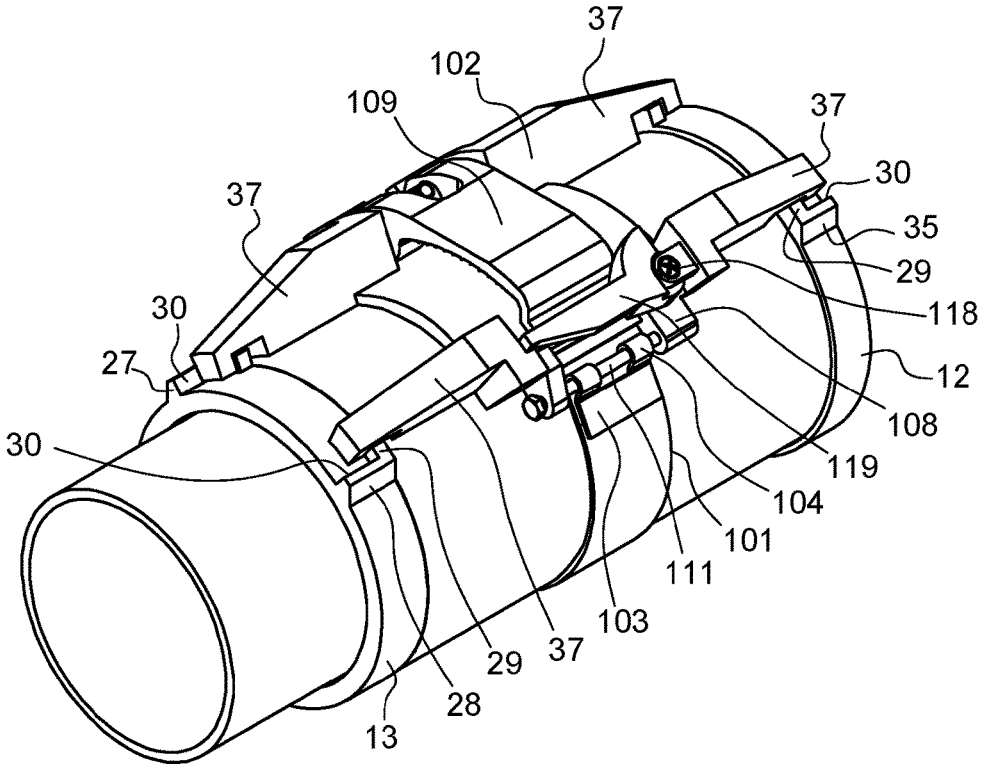
FIG. 3 is a schematic view of the securing system of FIG. 1 mounted on the tube from a different angle of view compared to FIG. 2.

FIG. 3 shows another angle of view of the securing system 1 of FIG. 2. In this chosen angle of view, is illustrated the layout between the first terminal sleeve 104 of the band 101 and the first terminal sleeve 108 of the central body 102 which both house the same first shaft 111. Thus, said shaft 111 is slid inside both the first terminal sleeve 104 of the band 101 and the first terminal sleeve 108 of the central body. In this configuration there is no distance separating the band 101 and the central body 102 as they are closely bonded together.

Is also shown the holding mechanism 118 which is housed on the central body 102. Said holding mechanism 118 comprises a holding lever 119 which provides reinforcement to maintain the locking lever 109 in a closed state. More details on the holding mechanism 118 are furtherly described in view of FIGS. 8 and 9.

The cooperation between the central body 102, the first ring 12, the second ring 13 and the tube is described below in view of FIGS. 4 to 6.

Figure 4:
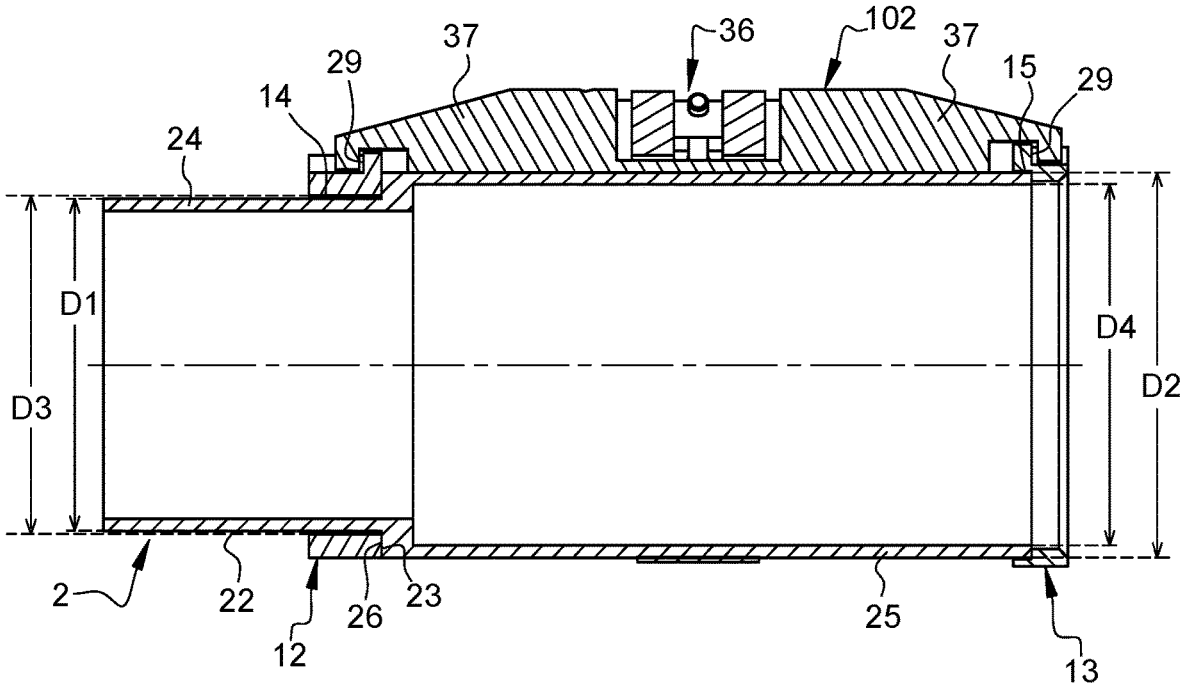
FIG. 4 is a cross sectional view of the securing system mounted on the tube of FIG. 2 or 3 in a plane parallel to the longitudinal axis of the tube.
Figure 5:
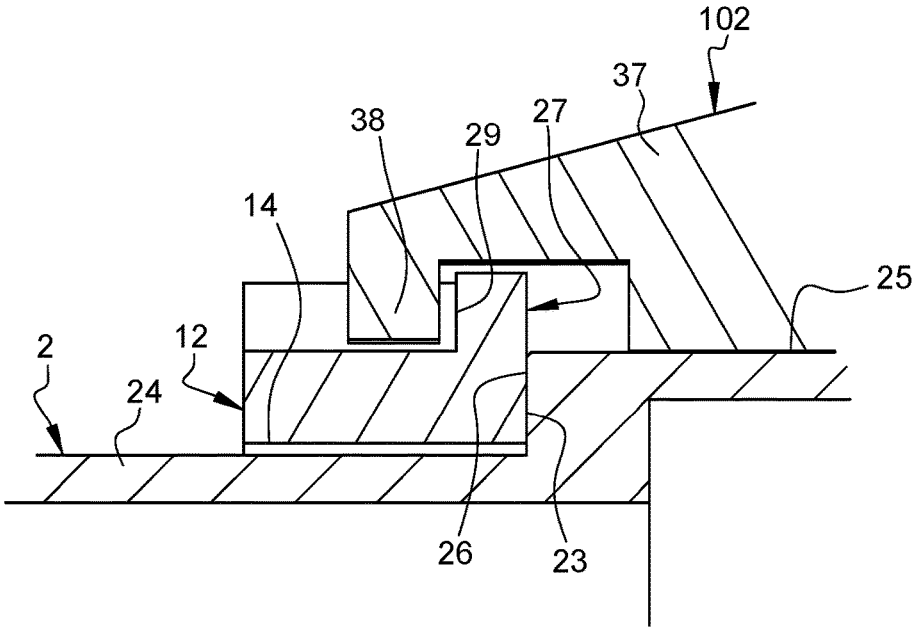
FIG. 5 is a detailed view of FIG. 4 showing the cooperation between a first longitudinal end of a central body of the securing system, a first ring of the securing system and the tube.
Figure 6:
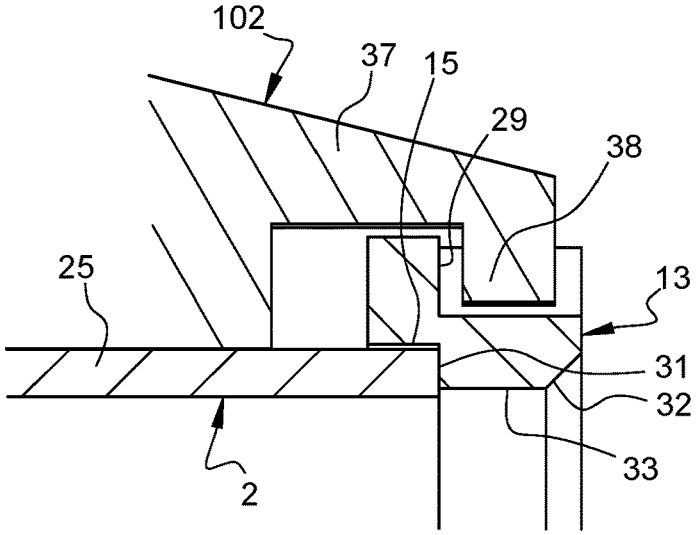
FIG. 6 is a detailed view of FIG. 4 showing the cooperation between a second longitudinal end of the central body of the securing system, a second ring of the securing system and the tube.

As shown on FIG. 4 or 5, an outside surface 22 of the tube 2 comprises an outside shoulder 23. This outside shoulder 23 extends radially such that the tube 2 has a main outside diameter D1 for a main portion 24 of the tube 2 and a terminal outside diameter D2 for an end portion 25 of the tube 2, said end portion 25 of the tube 2 comprising an inner threaded portion for receiving an outer threaded portion of another tube. The main outside diameter D1 of the tube 2 is smaller than the terminal outside diameter D2 of the tube 2.

The first ring 12 has an inner surface 14 extending circumferentially. The diameter D3 of the inner surface 14 is larger than the main outside diameter D1 of the tube 1 and smaller than the terminal outside of the tube D2. Therefore, the first ring 12 can be mounted on the main portion 24 of the tube 2 such that the inner surface 14 surround said main portion 24 of the tube 2.

The first ring 12 further comprises a lifting surface 26 extending radially outward from the inner surface 14. This lifting surface 26 is facing the outside shoulder 23 of the tube 2 in a mounted state of the first ring 12 such that said lifting surface 26 can bear against the outside shoulder 23 of the tube 2. The first ring 12 can therefore be used to lift the tube 2, or even a complete string comprising a plurality of tubes screwed together, by abutment of the lifting surface 26 on the outside shoulder 23 of the tube 2. Especially, the same first ring 12 can be mounted on different tubes having different main outside diameters D1 smaller than the diameter D3 of the inner surface 14, as long as the terminal outside diameter D2 remains larger than said diameter D3 of the inner surface 14 such that the lifting surface 26 can bear against the outside shoulder 23 of the tube 2.

As shown on FIGS. 1 to 3, the first ring 12 further comprises a first blocking wall 27 and a second blocking wall 28 extending radially outward. Each of the first blocking wall 27 and second blocking wall 28 comprises a longitudinal portion and a circumferential portion. The longitudinal portion forms a longitudinal blocking surface 29 extending in a plane perpendicular to the longitudinal axis A1 and turned opposed to the second ring 13. The circumferential portion forms a circumferential blocking surface 30 extending radially outward and parallel to the longitudinal axis A1. The lateral blocking surface 30 of the first blocking wall 27 and the circumferential blocking surface 30 of the second blocking wall 28 are circumferentially facing each other.

The second ring 13 comprises an inner surface 15 extending circumferentially. The diameter of said inner surface 15 is larger than the terminal outside dimeter D2 of the tube 2. The second ring 13 comprises an inner shoulder 31. Said inner shoulder 31 extends radially from the inner surface 15 in a plane perpendicular to the longitudinal axis A1. A radially inner extremity of the inner shoulder 31 has a smaller diameter than the terminal outside diameter D2 such that said inner shoulder 31 bear against the terminal end of the tube 2. Moreover, said radially inner extremity of the inner shoulder 31 has a larger diameter than an inside diameter D4 of the end portion 25 of the tube 2 such that said inner shoulder 31 do not extends radially inwardly beyond the inside surface of the end portion 25 of the tube 2 and do not blocks the insertion of another tube inside the end portion 25 of the tube 2. Similarly to the first ring 12, the second ring 13 can be mounted on different tubes 2 having different terminal outer diameter D2 and inside diameter D4, as long as the inner surface 15 diameter remains larger than terminal outside dimeter D2 and the radially inner extremity of the inner shoulder 31 has a larger diameter than an inside diameter D4. It is therefore possible to use standards dimensions for the diameter of the first and second rings 12, 13 in order to install the securing mechanism 1 on different tube having different dimensions.

The second ring 13 comprises a guiding surface 32. The guiding surface 32 is tapered relative to the longitudinal axis A1 with a small diameter arranged closer from the tube 2 than a large diameter of said guiding surface 32. A central inner surface 33 of the second ring 13 extends parallel to the longitudinal axis A1 to join the radially inner extremity of the inner shoulder 31 to the small diameter of the guiding surface 32. Thanks to these features, the second ring 13 can be used as a stabbing guide for the insertion of another tube in the end portion 25 of the tube 2.

The second ring 13 comprises a first blocking wall 34 and a second blocking wall 35 similar to, respectively, the first blocking wall 27 and a second blocking wall 28 of the first ring 12 as described above. The first blocking wall 34 and the second blocking wall 35 differs from the first blocking wall 27 and the second blocking wall 28 in that the longitudinal blocking surfaces 29 of the first ring 12 and the longitudinal blocking surface 29 of the second ring 13 have opposed orientation along the longitudinal axis A1, the longitudinal blocking surface 29 of the first ring 12 being turned away from the second ring 13 and the longitudinal blocking surface 29 of the second ring 13 being turned away from the first ring 12.

The central body 102 comprises a main portion 36 and two pairs of legs 37. The main portion 36 as described above cooperate with the band 101 to fix said central body 102 on the tube 2. Each leg 37 of a pair of legs 37 extends longitudinally from of the main portion 36 of the central body 102, from a circumferential side in the embodiment shown on the figures. The legs 37 of a first pair of legs 37 extends longitudinally from the main portion 36 towards the first ring 12 and beyond a respective longitudinal blocking surface 29 of the first ring 12. The legs 37 of a second pair of legs 37 extends longitudinally from the main portion 36 towards the second ring 13 and beyond a respective longitudinal blocking surface 29 of the second ring 13.

A longitudinal end of the legs 37 opposed to the main portion 36 of the central body 102 comprises a lug 38. Said lug 38 extends radially inwardly so as to be facing, along the longitudinal axis A1, a corresponding longitudinal blocking surface 29.

As shown on FIGS. 5, the legs 37 of the first pair of legs 37 cooperate in abutment with the longitudinal blocking surface 29 of the first ring 12 so as to block the movement of the central body 102 along the longitudinal axis A1 towards the second ring 13. Similarly, and as shown on FIG. 6, the legs 37 of the second pair of legs 37 cooperate in abutment with the longitudinal blocking surface 29 of the second ring 13 so as to block the movement of the central body 102 along the longitudinal axis A1 towards the first ring 12.

In other words, the legs 37 form hook which cooperate with the rings 12 and 13 to maintain the central body 102 and the rings 12 and 13 together along the longitudinal axis A1. Furthermore, as the first ring 13 is blocked in displacement towards the second ring 13, the lifting surface 26 bearing against the outside shoulder 23 of the tube 2, and the second ring 13 is also blocked in displacement towards the first ring 12, the inner shoulder 31 bearing against the terminal portion of the tube 2, the whole securing device 1 is blocked in displacement along the longitudinal axis A1 when said securing system 1 is mounted on the tube 2. It is therefore possible to pre-install the securing system 1, for instance during manufacturing process, and the securing system 1 will remain installed on the tube 2 during all steps of transportation to the installation site. Moreover, the second ring 13 provides a protection to the terminal end of the tube 2, for instance during transportation or stockage. Furthermore, as the second ring 13 comprises the guiding surface 32, there is no need for installation of guiding means for insertion of another tube on the rig if the securing system 1 is pre-installed, saving the corresponding installation time on the rig.

As shown on FIGS. 1 to 3, the lugs 38 of the legs 37 each circumferentially faces a respective circumferential blocking surface 30. As the circumferential blocking surfaces 30 of each ring 12 and 13 are circumferentially facing, the rings 12 and 13 and the central body 102 are blocked in relative rotation around the longitudinal axis A1 thanks to the abutment of the lugs 38 on the corresponding circumferential blocking surface 30 of the first ring 12 and second ring 13.

The longitudinal blocking surface 29 and the circumferential blocking surfaces 30 should be made according to other embodiments. For instance, the first blocking walls 27, 34 and the second blocking walls 28, 35 could be replaced by grooves or holes extending radially in the radial thickness of the rings 12, 13. The longitudinal blocking surface 29 and the circumferential blocking surfaces 30 would therefore be formed by the walls defining said grooves or holes in the thickness of the rings 12, 13. Moreover, the lugs 38 would extend radially inwardly inside said grooves or holes to cooperate with the longitudinal blocking surface 29 and the circumferential blocking surfaces 30.

Using a first ring 12 for lifting the tube 2, or the string, a second ring 13 for guiding the insertion of another tube in the terminal end of the tube 2, and a central body 102 comprising the cable securing mechanism 9 for securing the cable 5 to the tube 2 as explained above allows manufacturing said rings 12, 13 and central body 102 using materials adapted to the associated function. For instance, the first ring 12 is manufactured in a material having enough mechanical resistance to resist to the weight of the tube 2, or the string. Such a material for the first ring 12 is, for instance metal with high yield strength, for instance above 110 ksi. As the second ring 13 main functions are to protect the terminal end of the tube 2 and guide the insertion of another tube, the chosen material for manufacturing said second ring 13 can be lighter than the material used for the first ring 12. Such a material for the second ring 13 is, for instance 316 stainless steel or other stainless steels. Similarly, the material for manufacturing the central body 102 can be selected according to its functions, mainly securing the cable 5, support the weight of the cable 5 and maintain together the rings 12, 13 and the central body 102, and therefore can be for instance made of 316 stainless steel or other stainless steels or corrosion resistant metal.

Figure 7:
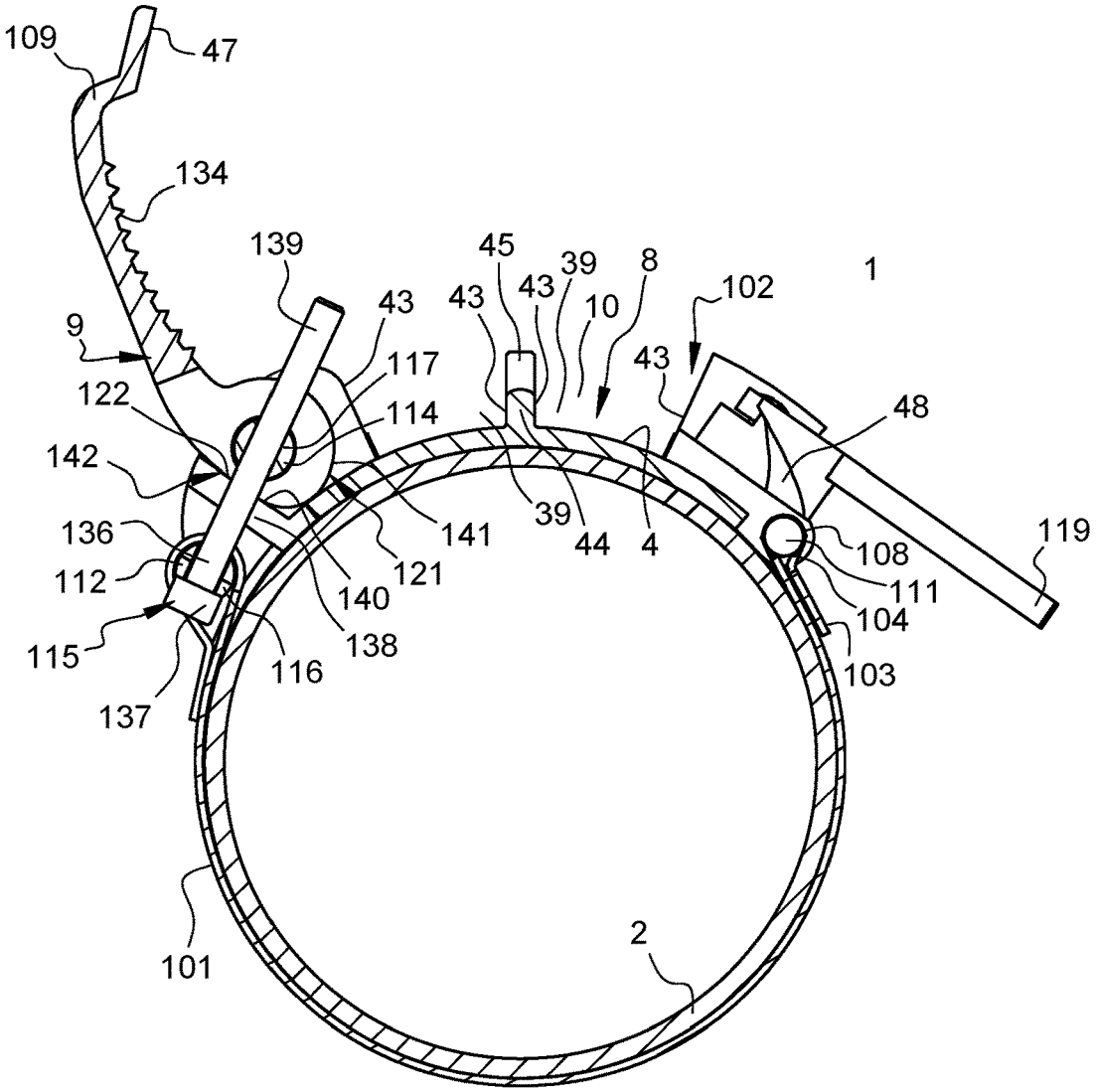
FIG. 7 is a cross sectional view of a securing system mounted on a tube in a plane perpendicular to the longitudinal axis of the tube and in an opened state of the fixing mechanism.
Figure 8:
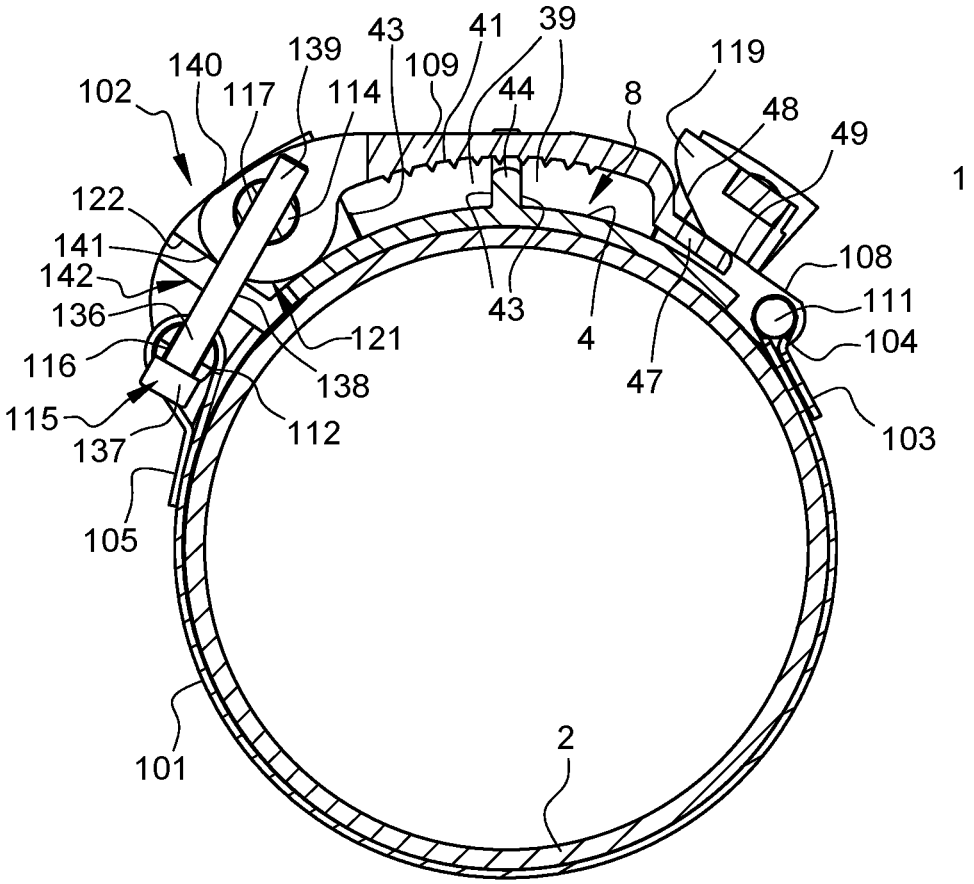
FIG. 8 is a cross sectional view of a securing system mounted on a tube in a plane perpendicular to the longitudinal axis of the tube and in a closed state of the fixing mechanism.

The tube fixing mechanism 6 is now described in detail in view of FIGS. 7 to 8. FIGS. 7 and 8 show the securing system 6 respectively in an opened state and a closed state of the fixing mechanism 6.

As shown in FIG. 7, the band 101 circumferentially surround the tube 2, from the first terminal end 103 to the second terminal end 105. As explained above, the first shaft 111 is housed both in the first terminal sleeve 104 of the first terminal end 103 of the band 101 and in the first terminal sleeve 108 of the central body 102 such that the first terminal end 103 of the band 101 end is pivotably mounted on the central body 102 and is fixed to the central body 102 along a circumferential direction and a radial direction.

The second terminal end 105 of the band 101 is linked to the locking lever 109 thanks to the pretention screw 115 and the rotational shaft on which is mounted the locking lever 109. A first end 136 of the pretention screw 115 passes between the two portions of the second terminal sleeve 106 of the band 101 and through the through hole 116 in the second shaft 112 housed in the second terminal sleeve 106. A head 137 of this pretention though 115 is arranged on a side of the second shaft 112 which is opposed to the central body 102. This head 137 has larger dimensions than the through hole 116 in the second shaft 112 such that said head 137 of the pretention screw 115 bears against the second shaft 112 when the pretention screw 115 is pulled towards the central body 102. The pretention screw 115 passes through a passage 138 in the central body 102. A second end 139 of the pretention screw 115 opposed to the head 137 is threaded. The hollowed cavity 117 of the rotational shaft 114 is also threaded. The second end 139 of the pretention screw 115 is screwed in the threaded hollowed cavity 117 of the rotational shaft 114 housed in the locking lever 109. Thus, by screwing more or less the pretention screw 115 in the rotational shaft 114, the head 137 of the pretention screw 115 and therefore the second terminal end 105 of the band 101 can be adjusted in a closed or away position relative to the central body 102.

Moreover, as explained above, the fixing mechanism 9 comprises a cam mechanism. This cam mechanism comprises a first cam surface 121 arranged on the locking lever 109 and a second cam surface 122 arranged on the central body 102.

The first cam surface 121 has a plane portion 140 and a curved portion 141. The curved portion as a curvature configured such that the rotational axis A2 of the rotational shaft 114 on which is mounted the locking lever 109 is therefore closer from the plane portion 140 than from the curved portion 141. In other words, the shortest distance between the curved portion 141 and said rotational axis A2 is located at the joining portion between the plane portion 140 and the curved portion 141.

The second cam surface 122 is plane and extends radially. On the embodiment shown on FIGS. 7 and 8, the central body 102 comprises a flange 142 extending radially outward and along the longitudinal axis A1. This flange 142 comprises the passage 138 for the pretention screw 115 and forms the second cam surface 122.

As shown on FIG. 7, in the open state of the fixing mechanism 6, the locking lever 109 is opened and the plane portion 140 of the first cam surface 121 is bearing against the second cam surface 122. Consequently, the rotational shaft 114 is close from the flange 142 and the head 137 of the pretention screw 115 is away from the central body 102. As the head 137 is away from the central body 102, the band 101 is loose and the central body 102 can be turned around the tube 2. Moreover, in this opened state of the locking lever 109, the locking lever 109 mainly extends radially such that said locking lever 109 is away from an opening 10 of the outside housing 8 of the cable securing mechanism 9, said opening 10 being free such that the cable 5 can be pulled inside the outside housing 8.

In order to switch the fixing mechanism 6 from the opened state shown on FIG. 7 to the closed state shown on FIG. 8, the locking lever 109 is turned around its rotation axis towards the opening 10 of the outside housing 8. During this rotation, the first cam surface 121 and the second cam surface 122 cooperate by switching the portion of the first cam surface 121 bearing against the second cam surface 122 from the plane portion 140 of the first cam surface 121 to the curved portion 141 of the first cam surface 121. As the curved portion 141 of the first cam surface 121 is brought in cooperation with the second cam surface 122, the rotational shaft 114 is moved away from the flange 142 of the central body 102. By moving away the rotational shaft 114 from the flange 142, the head 137 of the pretention screw 115, and consequently the second terminal end 105 of the band 101, is pulled closer to the central body 102. This displacement of the second terminal end 105 of the band 101, while said band 101 surrounds circumferentially the tube 2 and the first terminal end 103 of the band 101 is circumferentially fixed on the central body 102, tightens the band 101 on the tube 2 such that said band 101 bear against the tube 2 and applies a force on the tube 2 blocking the rotation of the band 101 and the central body 102 on the tube 2. In other words, closing the locking lever 109 bring the second terminal end 105 of the band 101 closer to the central body 102 and tighten the band 101 around the tube 2 so as to fix the securing system 1 on the tube.

Thanks to such a fixing mechanism 6, the securing system 1 can be lock or unlock in rotation around the tube 2 easily. Indeed, switching the fixing mechanism 6 from the closed state in which the securing system 1 is fixed to the tube 2 to the opened state in which the securing mechanism 1 can be turned around the tube 2 can be easily done just by opening the locking lever 109. Moreover, as in the opened state the securing system 1 still surround the tube 2, thanks to the band 101 with the two terminal ends 103, 105 linked to opposed sides of the central body 102, the securing system 1 can only be turned around the tube 2 and cannot be radially moved away from the tube 2. As explained above, as the central body 102 is blocked along the longitudinal axis A1 thanks to the first and second rings 12 and 13, said securing system 1 is also blocked along the longitudinal axis A1. Consequently, the securing system 1 can easily be turned around the tube 2 in order to change the orientation of the opening 10 of the outside housing 8 while the securing system 1 remains on the tube 2.

Moreover, during this rotation from the opened position to the closed position, the locking lever 109 is turned down so as to cover the opening 10 of the outside housing 8, the locking lever 109 forming a lid for said outside housing 8 in order to block the cable 5 inside the outside housing 8. In the closed state of the fixing mechanism 6, the locking lever 109 mainly extends circumferentially and cover the central body 102 and the outside housing 8.

During the installation of the pretention screw 115, the pretention screw 115 screwed in the hollowed cavity 117 such that the distance around the tube 2, which is defined by the circumferential length of the band 101 and the pretention screw 115, between the first shaft 111 and the first cam surface 121 is shortest than the distance around the same portion of the tube 2 between the first shaft 111 and the radial outward extremity of the second cam surface 122, said distance comprising a circumferential and a radial components. Thanks to these features, the locking lever 109 cannot be moved radially away from the central body and the first cam surface 121 remains in contact with the second cam surface 122 even during a rotation of the locking lever 109. In order to further maintaining the locking lever 109 radially linked to the central body, the second cam surface could be slightly tapered towards the locking lever 109, thus increasing the difference between the above-mentioned distances. In another embodiment, the passage 138 in the flange 142 is a window, the pretention screw 115 passing through said widow and therefore being blocked radially away by abutment on an upper portion of the flange 142 delimiting said window. In another embodiment, the central body could have slotted housing for housing and guiding in displacement two longitudinally opposed end of the rotation shaft 114.

In the embodiment shown on FIGS. 7 and 8, the outside housing 8 of the cable securing mechanism 9 comprises two grooves 39. Said grooves 39 are arranged on an outer surface 4 of the central body 102 and can each house one or a plurality of cables 5. Each groove 39 extends parallel to the longitudinal axis A1. Each groove 39 comprises an opening having a first longitudinal side portion 40, a central portion 41 and a second longitudinal side portion 42. The central portion 41 extend longitudinally from the first longitudinal side portion 40 to the second longitudinal side portion 42. Said opening of the grooves 39 form the opening 10 of the outside housing 8. In other words, each groove 39 has a "U" shape cross section in a plane perpendicular to the longitudinal axis A1 with a bottom formed by the outer surface 4 of the central body 102 and the two sides formed each one by lateral walls 43. These lateral walls 43 are mainly extending radially outward and parallel to the longitudinal axis A1. The lateral walls 43 can be continuous or discontinuous. In the embodiment shown on FIGS. 7 and 8, the central body 102 comprises a rib 44 extending continuously and longitudinally from the outer surface 4. This ribs 44 forms a respective first lateral wall 39 for each of the two grooves 39, said rib 44 separating said two grooves 39. This rib 44 comprise an outer recess 45 for receiving the locking lever 109 without blocking its rotation. The others lateral walls 43 are discontinuous and formed by the legs 38 and the locking lever 109.

An outside housing 8 formed by one or a plurality of such grooves 39 has an opening 10 which is radially reachable for one or a plurality of cables 5 which would be pulled into the outside housing 8. Moreover, such grooves 39 having a opened first longitudinal side portion 40 and second longitudinal side portion 42 can house long cables 5, the cables 5 being pulled in the groove 39 through the central portion 41 of the opening and said long cables 5 extending through the first longitudinal side portion 40 and the second longitudinal side portion 42. Thus, when the locking lever 109 is turned down for switching le tube fixing mechanism 6 in the closed state, said locking lever 109 block the long cables 5 in the groove 39 by covering the central portion 41 of the opening 10 while the cable 5 still passes through the first longitudinal side portion 40 and second longitudinal side portion 42.

The grooves 39 can have a radial depth shortest than the diameter of the cables 5 such that the locking lever 109 clamps the cables 5 in the grooves 39, thus maintaining the cables 5 in position in both the radial direction and the longitudinal direction. The groove 39 and/or the locking lever 109 could also have grabbing surfaces, such as teeth or ribs, clamping the cables 5 in the grooves 39. The outside housing 8 could also have deformable clips (not shown) for clamping the cables 5 in the outside housing 8.

The cable securing mechanism 9 can have different embodiments for blocking the cable 5 in the outside housing 8. For instance, the lid could be separate from the locking lever 109 such that the locking lever 109 main function would be to tighten the band 101 on the tube while an independent lid (not shown) mounted in rotation on the central body 102 could be used for closing the outside housing 8.

In the embodiment shown on FIGS. 7 and 8, the securing system comprises a holding lever 119. The holding lever 119 is pivotably mounted on the central body 102 on the same lateral side than the first terminal end 103 of the band 101. The holding lever 119 is mobile in rotation around an axis which is perpendicular to the longitudinal axis A1. The holding lever 119 is switchable between a first position in which said holding lever 119 does not interfere with the rotation of the locking lever 109 and a second position in which said holding lever 119 covers an end 46 of the locking lever 109 opposed to the rotational shaft 114. The holding lever 119 extends mainly orthoradially in the open position shown on FIG. 7 and is parallel to the longitudinal axis A1 in the closed position shown on FIG. 8.

The end 46 of the locking lever 109 comprises a recess 47 which is, when the locking lever is covering the opening 10, radially inwardly offset relative to a main portion of said locking lever 109, said main portion of the locking lever forming the lid for the outside housing 8. The holding lever 119 covers said recess 47 in the closed position of the locking lever 109 and the closed position of the holding lever 119 such that the locking lever 109 cannot be opened without firstly opening the holding lever 119. Thanks to this holding lever 119, the locking lever 109 can therefore be maintained in the closed position easily.

Figure 9:
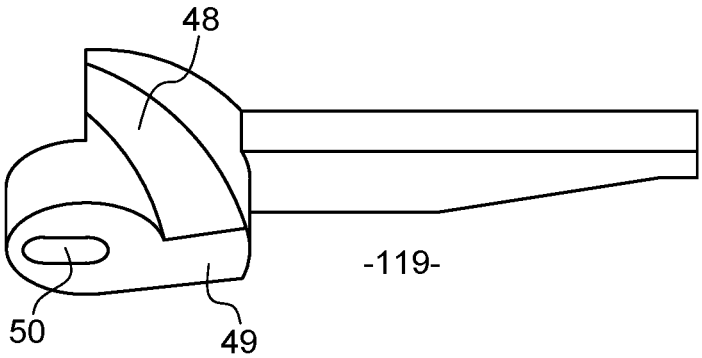
FIG. 9 is a detailed view of a holding lever of the securing system of FIG. 2 or 3.

As shown on FIG. 8 or 9, an inner surface 48 of the holding lever 119 is curved. The curvature of this inner surface 48 is such that the holding lever 119 has a thin radial thickness towards the locking lever 109 and a large thickness opposed to the locking lever 109. When the holding lever 119 is turned from its opened position to the closed position, the inner surface 48 with the thin portion of the holding lever 119 is firstly bring in contact with the outer surface of the recess 47 of the locking lever 109. Then, by further closing the holding lever 119, the recess 47 of the locking lever 109 is radially pulled towards the central body 102 by the inner surface 48 as the thickness of the holding lever raise due to the curvature of the inner surface 48 while the holding lever 119 is brought to the closed position. Such a curved inner surface 48 provides an easy manner to close the locking lever 109 as closing the holding lever 119 applies an increasing force on the recess 47 of the locking lever 109 pulling said locking lever 109 towards the central body 102. In order to maintain the cooperation of the holding lever 119 and the locking lever 109 in the closed position, the holding lever have a locking surface 49 which extends, when the holding lever 119 covers the recess 47, parallel to the outer surface of the recess 47 of the locking lever 109 so as to bear against the recess without applying force having a circumferential component.

According to an embodiment, the holding lever 119 can be pivotably mounted on the central body 102 using a slotted hole 50. In the closed state of the holding lever 119, such a slotted hole 50 extends in parallel with the longitudinal axis A1 in the closed position of the holding lever 119. Therefore, in said closed position of the holding lever 119, the holding lever 119 can be translated along the longitudinal axis A1 from a first closed position, in which the holding lever 119 can freely rotate around its rotation axis for moving from the closed position to the open position, to a locked position in which the holding lever 119 is locked in rotation around its rotation axis and maintained in the closed position, i.e. cannot be switched to the opened position. In said locked position, the holding lever 119 can be blocked in rotation thanks to, for instance, the abutment of a locking surface of the holding lever 119 on a corresponding locking surface on the central body 102, said locking surface being offset along the longitudinal axis A1 in the first closed position to allow the rotation of the holding lever 119.

The use of the verb "to have", "to comprise" or "to include" and any of its conjugated forms does not exclude the presence of elements or steps other than those stated in a claim. The use of the indefinite article "a" or "an" for an element or a step does not exclude the presence of a plurality of such elements or steps unless otherwise specified.

In the claims, any reference symbol in brackets is not to be interpreted as a limitation of the claim.

The invention claimed is:

1. A securing system intended to secure a cable to a tube for a tubular column for oil & gas, energy, or storage applications, said securing system comprising:

a bearing surface and an outside surface, the bearing surface being turned inwardly, said bearing surface defining an inside housing for the tube, the outside surface being turned outward relative to the bearing surface, a tube fixing mechanism having an open state and a closed state, the tube fixing mechanism being configured to fix the securing system on the tube in the closed state of the tube fixing mechanism, the tube being housed in the inside housing in said closed state of the tube fixing mechanism, said tube fixing mechanism being mobile relative to the tube in an open state of the tube fixing mechanism;

said tube fixing mechanism comprises a band, the band extending along a longitudinal axis, the band extending radially, the band extending around the tube, said band forming the bearing surface, wherein said securing system comprising a cable securing mechanism having an outside housing for securing the cable, said outside housing having an opening for receiving, through said opening, the cable inside the outside housing, said opening of the outside housing being arranged on the outside surface, wherein the tube fixing mechanism comprises a central body, and wherein the band has a first terminal end and a second terminal end the first terminal end being fixed to the central body, the second terminal end being mounted on the central body in a mobile relative to the central body between a closed position and a remote position, wherein the central body includes a locking mechanism, the locking mechanism includes a locking lever pivotably mounted on the central body by a rotational shaft, wherein the second terminal end of the band includes a second shaft, and wherein the locking mechanism includes a pretention screw which locks the rotational shaft and the second shaft together in the closed state.

2. The securing system according to claim 1, wherein the first terminal end of said band comprises a first terminal sleeve, the first terminal sleeve housing a first shaft, said first shaft fix the central body to the band.

3. The securing system according to claim 2, wherein the central body comprises at least a first terminal sleeve configured to house the shaft.

4. The securing system according to claim 1, wherein the second terminal end of said band comprises a second terminal sleeve housing the second shaft.

5. The securing system according to claim 1, wherein the locking mechanism is configured to bring the second terminal end of said band and the central body closer to each other in a closed state.

6. The securing system according to claim 5, wherein said locking lever is pivotably mounted on the central body and configured to rotate between an open state and the closed state.

7. The securing system according to claim 6, wherein said rotational shaft is parallel to the longitudinal axis (A1) of the tube fixing mechanism.

8. The securing system according to claim 6, wherein the locking lever comprises an inner surface facing the central body and the outside surface of the tube in the closed state, said inner surface comprising a grabbing surface designed to clamp the cable.

9. The securing system according to claim 6, wherein the cable securing mechanism comprises a holding mechanism configured to maintain the locking lever in the closed state.

10. The securing system according to claim 1, wherein said outside housing of the cable securing mechanism comprises at least one longitudinal groove parallel to the longitudinal axis, said longitudinal groove being able to house at least one cable.

* * * * *